United States Patent [19]

Haigis

[11] Patent Number: 4,867,089

[45] Date of Patent: Sep. 19, 1989

[54] STRUCTURAL SYSTEM FOR INCLINING SAILBOAT MASTS TO WINDWARD

[76] Inventor: Erich Haigis, Neutalweg 10, CH-4203 Grellingen, Switzerland

[21] Appl. No.: 167,647

[22] Filed: Mar. 14, 1988

[30] Foreign Application Priority Data

Mar. 26, 1987 [CH] Switzerland ..... 01148/87

[51] Int. Cl.[4] ..... B63B 39/00

[52] U.S. Cl. ..... 114/39.1; 114/39.2; 114/124; 114/143; 114/91

[58] Field of Search ..... 114/91, 121, 124, 138, 114/143, 140, 39.1, 39.2

[56] References Cited

U.S. PATENT DOCUMENTS

| | | | |
|---|---|---|---|
| 704,685 | 7/1902 | Jensen | 114/143 |
| 1,082,133 | 12/1913 | Olechnowicz | 114/124 |
| 1,331,202 | 2/1920 | Kitchen et al. | 114/124 |
| 3,972,300 | 8/1976 | Adamski | 114/124 |
| 3,985,106 | 10/1976 | Ross | 114/91 |
| 4,094,263 | 6/1978 | Marcil | 114/91 |
| 4,117,797 | 10/1978 | Kelly et al. | 114/91 |
| 4,748,927 | 6/1988 | Bujacich | 114/121 |

FOREIGN PATENT DOCUMENTS

| | | | |
|---|---|---|---|
| 37346 | 9/1911 | Sweden | 114/124 |

*Primary Examiner*—Sherman D. Basinger
*Assistant Examiner*—Stephen P. Avila

[57] ABSTRACT

The present invention relates to a structural system with which the mast of a sailboat can be forced against the wind and inclined to windward. This is accomplished with a new sailing element, a so-called "dolphin". The invention makes it possible to sail a sailboat using the same technique employed in windsurfing with a sailboard.

10 Claims, 10 Drawing Sheets

FIG. 1
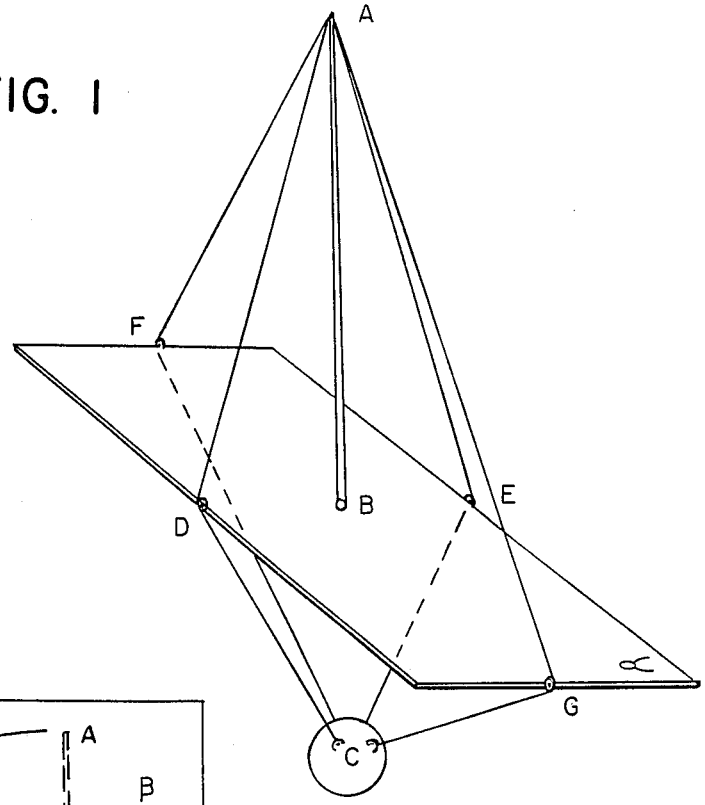
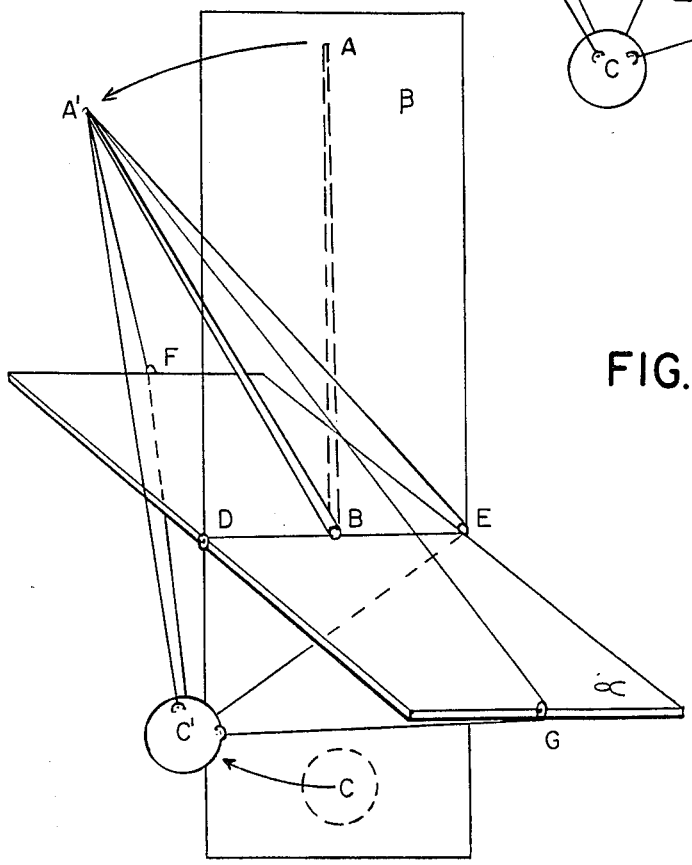
FIG. 2

FIG. 3
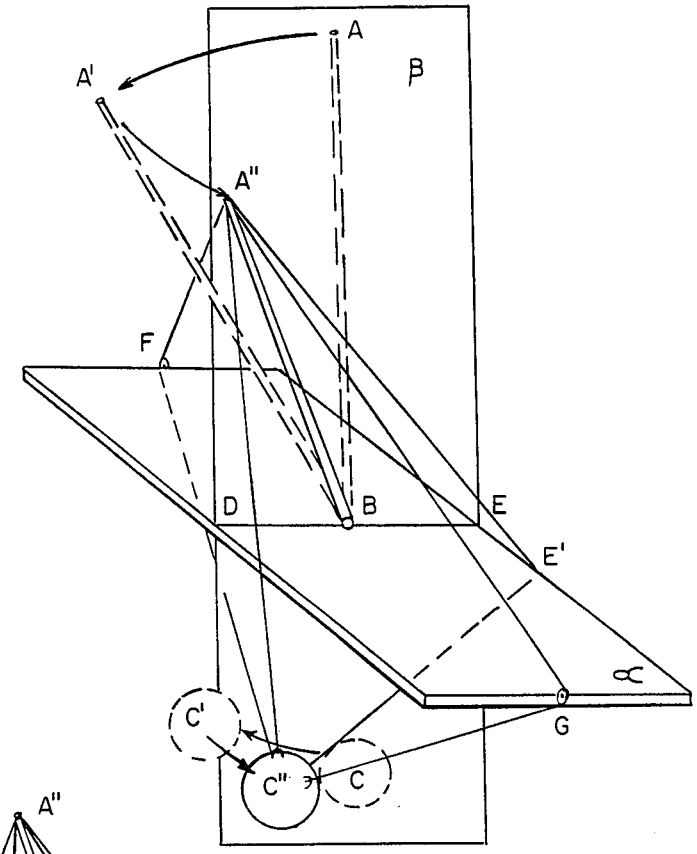
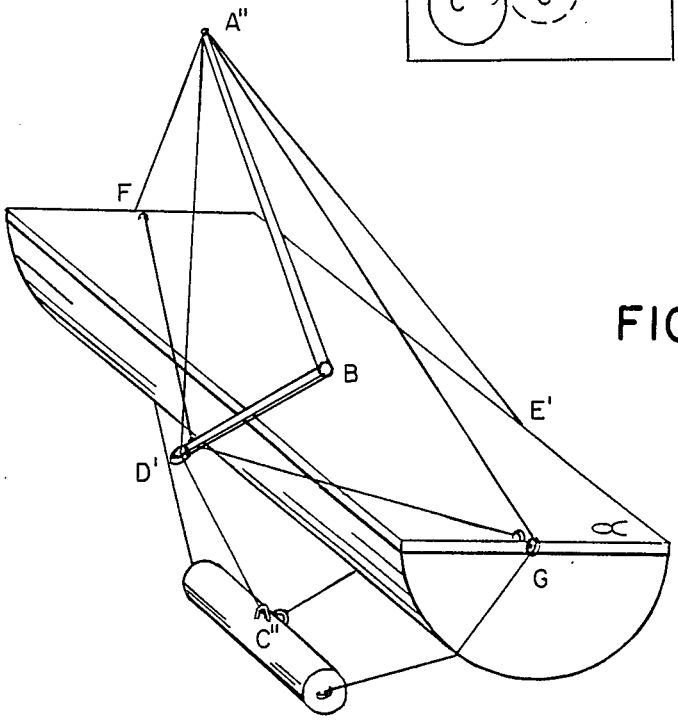
FIG. 4

FIG. 10
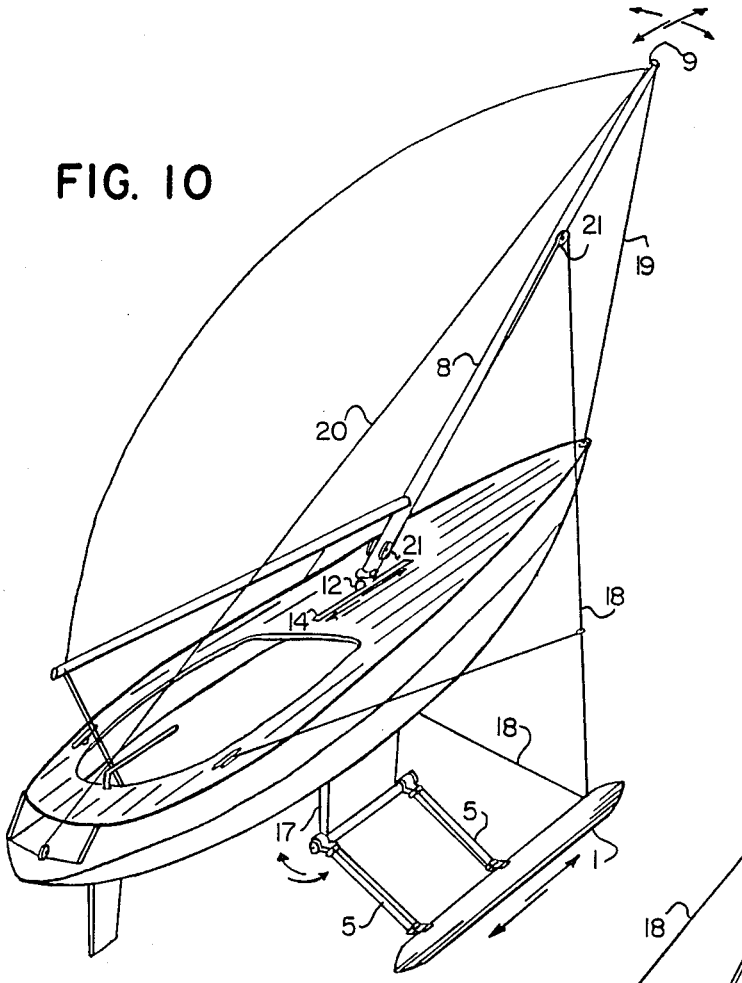
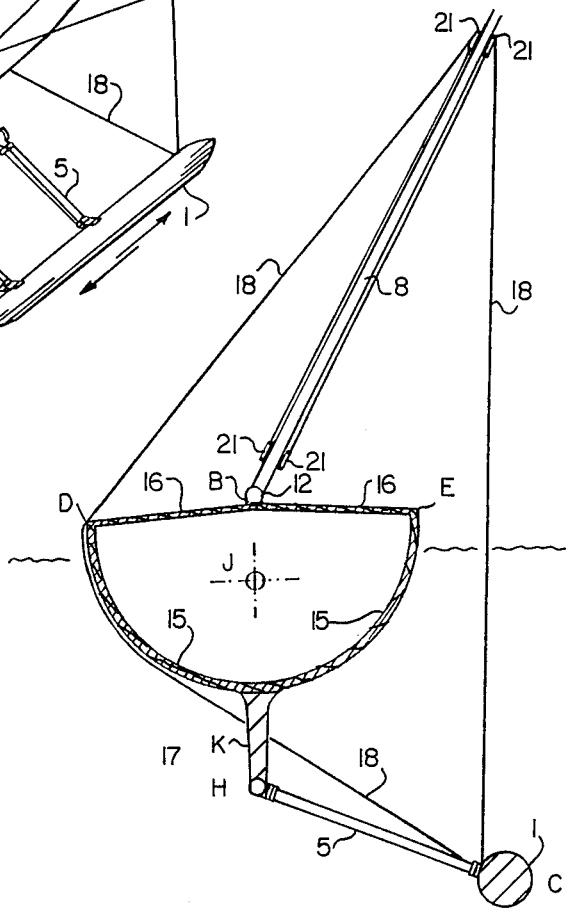
FIG. 11

FIG. 12
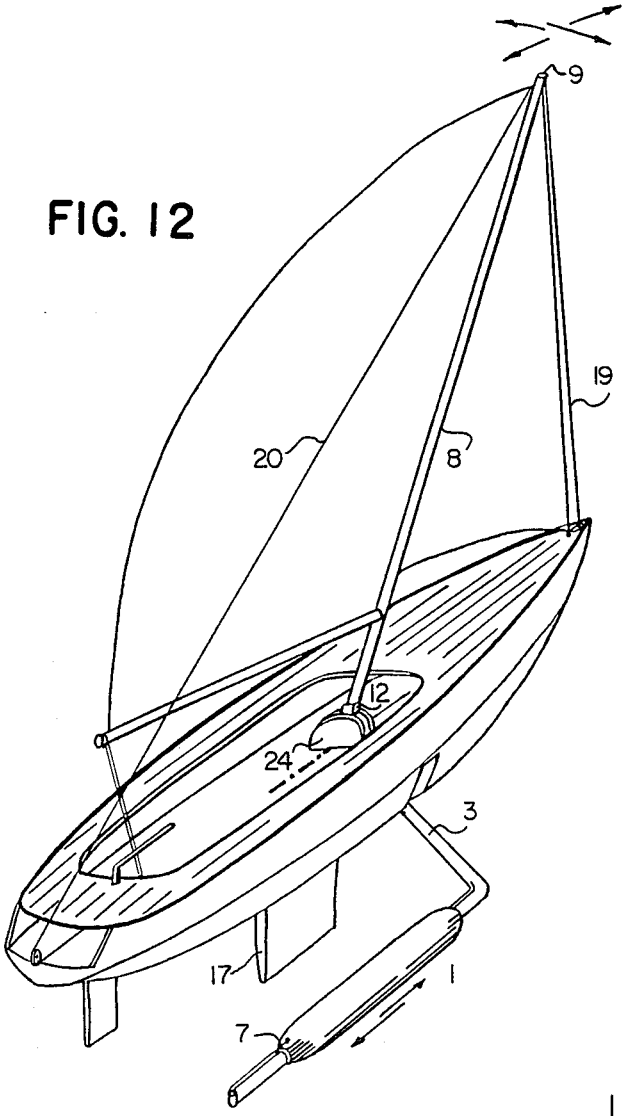
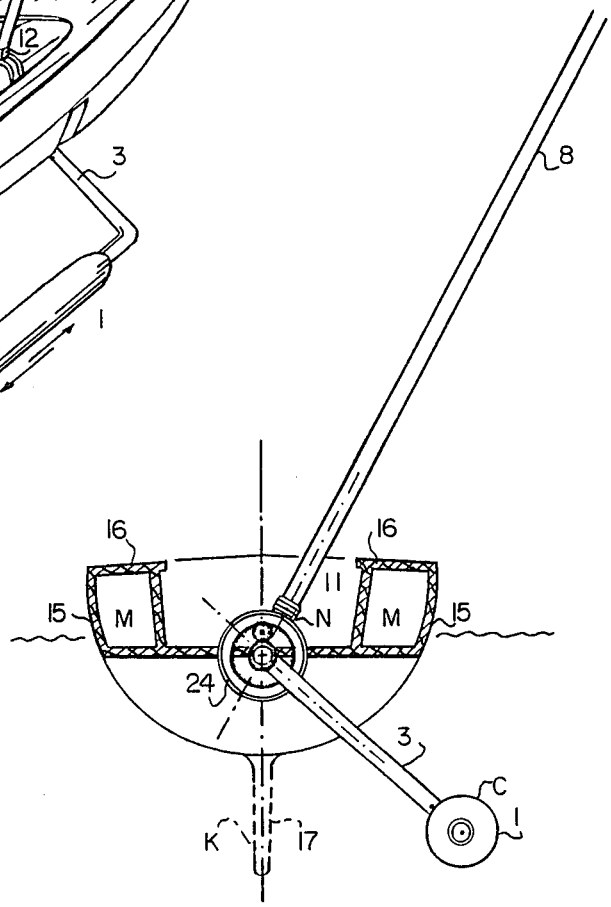
FIG. 13

FIG. 15
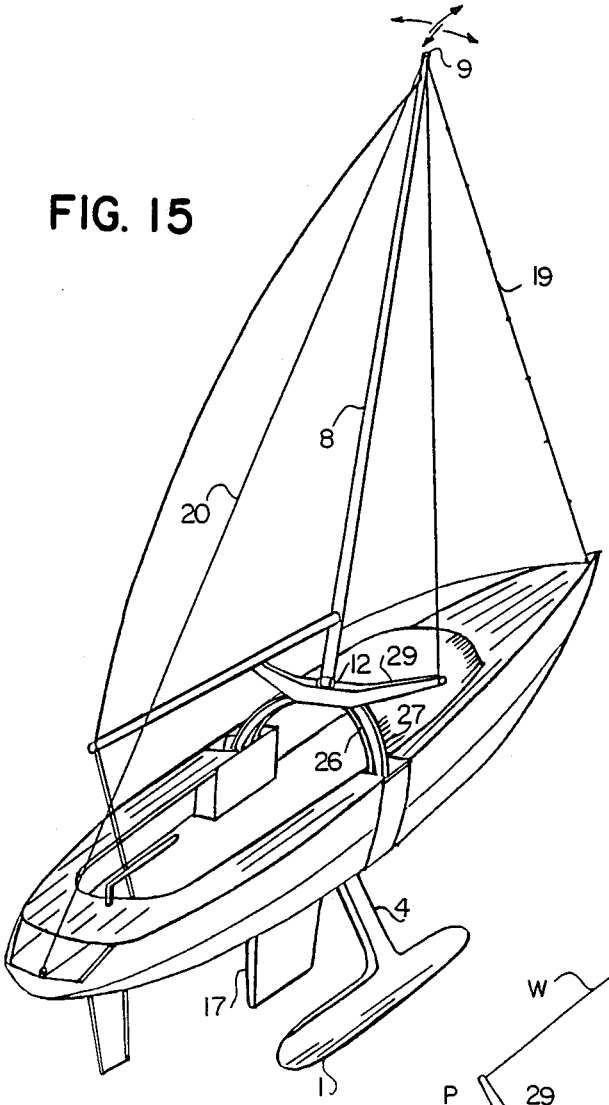
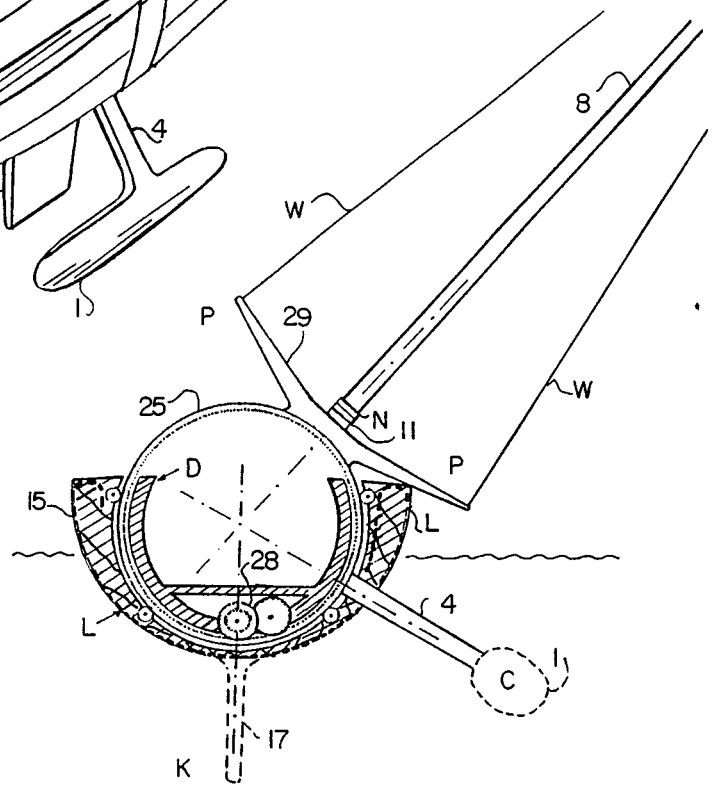
FIG. 16

STRUCTURAL SYSTEM FOR INCLINING SAILBOAT MASTS TO WINDWARD

BACKGROUND OF THE INVENTION

1. Field to which the Invention Relates

When conventional sailboats, be they yawls or yachts, are sailed close to the wind, the wind pressure causes the mast to lean to leeward. The rigid connection between mast and hull causes the boat to heel. To counteract the torque applied to the mast and therefore to the hull with a corresponding torque in the opposite direction, the load, i.e. the crew, is shifted to windward. On larger boats such as yachts the keel also contributes to this counteracting torque. Despite these counteractive torques, however, the conventional sailing technique allows the mast to be inclined to leeward and it also allows the hull to heel over.

The technique of windsurfing with a sailboat differs from the conventional sailing technique in that the mast is inclined to luff, i.e. to the windward side, rather than to leeward. A precondition for application of the windsurfing technique is that the mast be free to incline in any direction, i.e. not only sideways but also for and aft.

The present invention makes it possible first, to counteract the torque caused by the wind pressure and acting on the mast with a torque of the same magnitude in the opposite direction, second, to prevent the transmission of torques to the hull, and third, to shift the mast in any desired direction and hence to the particular position required for sailing according to the windsurfing technique.

2. Description of the Prior Art

People have been trying to counteract the heel of sailboats in various ways for a long time. One way is to use a heavier keel that is joined rigidly to the hull, and the weight of which reduces the boat's heel. Mechanisms are also known with which the boat's cargo or weights carried specifically for the purpose in the hull can be shifted to windward. It is common sailing practice to position the crew on the windward side of the boat. The crew's weight can be utilized even better by leaning out on trapeze rigging. In the case of catamarans, an even greater torque can be produced to counteract that acting on the mast because the crew is positioned on the windward side with a longer lever arm.

U.S. Pat. No. 3,985,106 describes a system that enables the mast to be inclined a few degrees out of the vertical to leeward to a limited angle around the boat's fore-aft axis. Corresponding to this inclination, the keel is swung out to the opposite side, the windward side. As a result, the heel of the boat's hull can be counteracted somewhat more than usual.

U.S. Pat. No. 4,094,263 describes a similar system. Here again the mast can be inclined in a plane at right angles to the boat's fore-aft axis. The maximum possible inclination angle of the mast to leeward is greater than in the case of U.S. Pat. No. 3,985,106, but it remains restricted because of the connection with the movable keel. With this system, too, the keel swings to windward in order to increase the pull-back torque on the mast, which is being forced to leeward by the pressure of the wind.

U.S. Pat. No. 4,117,797 is largely similar to U.S. Pat. No. 4,094,263. In addition to a mechanical tackle connection between inclinable mast and inclinable keel, however, it also proposes a hydraulic system for moving mast and keel. But the system continues to pursue the purpose of swinging the keel out to windward when sailing close to the wind, i.e. in opposition to the inclination of the mast, in order to reduce the heel of the boat's hull.

France Pat. No. 2,323,574 describes another similar system with which the mast can be inclined in a plane at right angles to the boat's fore-aft axis. Once again the proposed mechanism pursues the purpose of swinging the keel out in the direction opposite to the mast's inclination.

All of the aforementioned designs are based on conventional sailing technique, namely allowing the sail and mast to tilt to leeward when sailing close to the wind. Accordingly, the crew, cargo and keel weights are shifted as far as possible to windward in order to keep the mast upright. Some designs employ a mast that can be inclined sideways at a restricted angle in the plane that lies at right angles to the boat's fore-aft axis. No patent refers to a mast foot support permitting unrestricted inclination in any direction.

Apart from this state of the art in boatbuilding, there is also a state of the art in the construction of sailboards. Here a mast foot allowing unrestricted inclination of the mast in any direction is a known design feature. But this rotating mast foot is mounted on a sailboard, not on a boat's hull. The windsurfing principle is not transferable to sailing devices such as sailboats with greater sail area, because the weight of the human body is insufficient to counteract the wind power effected on larger sails.

3. Description of the New Knowledge

In contrast to the described traditional sailing technique, in which the mast and sail tilt to leeward by the force of the wind, the technique of sailing a windsurfing sailbaord demonstrates that a converse type of sailing is possible as well. In windsurfing, the mast and sail are pulled to windward. This produces advantages in comparison with the old sailing technique. The purpose of the present invention is to transfer these advantages of the mast and sail position in windsurfing to a sailboat (yawl or yacht) and to construct a system with which the mast of a sailboat can be inclined to windward and held there. It is surprising to note that such systems do not exist.

What is new is that the sailboat mast, like that of a sailboard, is supported in a mast foot that allows the mast to be inclined in any direction. It is not enough simply to support the mast in a hinge joint. In contrast to the previous systems with inclinable masts, which allow the mast to tilt only in a single plane lying at right angles to the hull's fore-aft axis, the invention proposes for the first time that the mast of yawls and yachts be supported to allow unrestricted inclination in any direction.

Also new is the proposal that, in contrast to windsurfing equipment, a weight or "dolphin" be used in addition. This "dolphin" is a new element that has never been used in conjunction with sailboats or sailboards in the past. The dolphin is neither a keel nor a centreboard. It is still necessary to fit a keel or centreboard to the boat's hull.

It is also new that a sailboat build according to the new system consists of three parts, namely: 1. of a hull with keel or centreboard; 2. of a mast that is, with respect to the hull, freely inclinable in any direction; and 3. of a "dolphin", which is movable to port or starboard as well as to the bow or the stern.

It is also new that the opposing force to the force of the wind acting on the sail is produced by the dolphin and that, because of this, the hull remains unaffected by the rotation of the mast.

Finally, it is new that this system makes it possible to sail a sailing device larger than a sailboard (i.e. a sailboat) using the windsurfing technique.

BRIEF DESCRIPTION OF THE INVENTION

The present invention relates to a structural system with which the mast of a sailboat can be forced to windward (luff) and can also be inclined abaft. The invention makes it possible to sail a sailboat using the new sailing technique employed in windsurfing with sailboards.

The invention includes a mast foot supported in a joint that allows the mast to be inclined in any direction. This prevents a torque applied to the mast by the wind pressure from being transmitted to the hull. The mast is held upright, or inclined in any desired direction, by a "dolphin", a pendulum weight arranged beneath the hull. Various suspension systems are described for connecting the dolphin to the mast and for connecting the dolphin to the hull.

The actual invention comprises the invention of the dolphin as a new sailing element and its connection to the mast by means of suspension systems in such a way that the angle formed by the mast tip, the mast foot, and the dolphin's center of gravity can be changed and selected and fixed at will. The mast can be controlled by changing the position of the dolphin and can be inclined both to port and starboard and fore and aft. This makes it possible to sail a sailboat using the technique of a windsurfing sailboard; in other words, the mast can be held inclined to windward (luff) and astern.

DESCRIPTION OF THE DRAWINGS

FIGS. 1 to 4 show diagramatically how the inclination of the mast sideways and fore and aft can be set by positioning the dolphin accordingly. FIGS. 5 to 17 show various examples of ways the invention can be practically executed and applied.

FIG. 1 shows diagramatically how the mast is supported by a ball-and-socket joint (B) on load-bearing surface $\alpha$ and how it carries a suspension system on which the pendulum weight, the dolphin (C), hangs. The suspension system, shown in the illustration as a system of ropes, is free to move by virtue of the pulleys at D, E, F and G and does not transmit any torque to the load-bearing surface $\alpha$.

FIG. 2 shows how the mast can be swung out sideways in the imaginary plane $\alpha$, which is perpendicular to the load-bearing surface $\alpha$ and to the fore-aft axis FG. To do this it is necessary to shorten the distance between A' and C', i.e. between the top of the mast and the dolphin, and to lengthen the distance from A' via E to C' accordingly. As a result, the dolphin is hoisted sideways. The changes in the positions of the mast and dolphin are mutually dependent. They can also be defined as a reduction of the angle A'BC'. Of course it is also possible to hoist the dolphin the same way on the opposite side to incline the mast on that side.

FIG. 3 shows how it is possible not only to swing the mast out to the side, but also, for instance, to incline it toward the stern with the tip of the mast at A'' (F is the bow and G the stern of the load-bearing surface $\alpha$). To do this it is necessary to shorten the rope length A''GC'' and to lengthen the distance from A'' via F to C'' accordingly. This shifts the dolphin aft.

FIG. 4 shows the load-bearing surface $\alpha$ as the deck of a floating body. The dolphin is no longer shown symbolically as a pendulum sphere, but as an oblong, cylindrical body. A new, additional element shown is an outrigger spar with which the rope leading from A'' to C'' can be pushed away from the hull to D'. This makes it possible to swing the dolphin further out to the side and increase the torque applied to the mast. The outrigger spar can be freely movable at point D' (open eye) or be fastened to the rope A''C'' by a clamping device. The outrigger spar is fixed in the fore-aft direction so that the angle D'BG can be established.

FIG. 5 shows a sailboat with a "dolphin" suspended from the top of the mast. The four rigging ropes are fastened rigidly to the dolphin. The desired hoisting or shifting to the stern of the dolphin, or that necessitated by the force of the wind on the sail, is accomplished by taking up or letting out the respective rigging ropes via the four pulleys at the top of the mast and the four pulleys athwart the mast at the bottom. The four ropes can be taken up or let out by means of winches with cranks. On the windward side, the rigging rope is held free of the hull by an outrigger spar. The outrigger spar is supported to swivel in a laterally adjustable foot. The outrigger spar is fastened to the hull near the stern by a line. The hull has one pulley each fore and aft over which the headstay and backstay can run freely. No pulleys are provided for the sidestays (shrouds), and it is necessary either to provide the hull with protection against rubbing wear or to use ropes with a protective sheath.

FIG. 6 shows a sailboat with the dolphin hung on a rope threaded through it that is attached to the bow and stern of the boat's hull. The dolphin can be pulled fore and aft along this rope. The headstay and backstay are fastened rigidly at the top of the mast but can be shortened at the bow and stern by means of tackle systems. Thus the inclination of the mast toward the bow or stern is independent of the position of the dolphin. The lateral inclination of the mast is accomplished by hoisting the dolphin and shifting it outward. The rigging ropes on the sides can be shortened or lengthened as required by means of tackle equipment and pulleys mounted at the top of the mast and athwart the mast at the bottom. The outrigger spar is supported to swivel in a laterally adjustable foot. It is fastened to the hull near the stern by a line. The foot of the mast is supported in a ball-and-socket joint that can be shifted fore and aft along a guide rail and arrested.

FIG. 7 shows a sailboat with the dolphin suspended laterally on a bar so that it can rotate freely. The dolphin can be shifted fore and aft along this bar. The centre of rotation of the bar can be set at various heights to suit requirements. For instance, it can coincide with the hull's centre of roll. In the example illustrated, the pivot point of the mast foot lies higher than the centre of rotation of the dolphin's suspension. The mast has a spreader carrying the pulleys for the dolphin's hoisting ropes. The hoisting ropes can be taken up or let out by means of a winch. The mast can be inclined toward the bow or stern by shortening or lengthening the headstay and backstay. In this alternative configuration, this movement of the mast takes place uninfluenced by the dolphin.

FIG. 8 shows a cross-section through the hull of the configuration according to FIG. 7. B=ball-and-socket joint at foot of mast; H=centre of rotation of the dolphin's suspension; C'=dolphin swung out to side;

J=hull's centre of roll. But the centre of rotation H can also be set lower than the centre of roll J in order to reduce roll. The dolphin (C) can swing past the keel (K).

Figure 9:
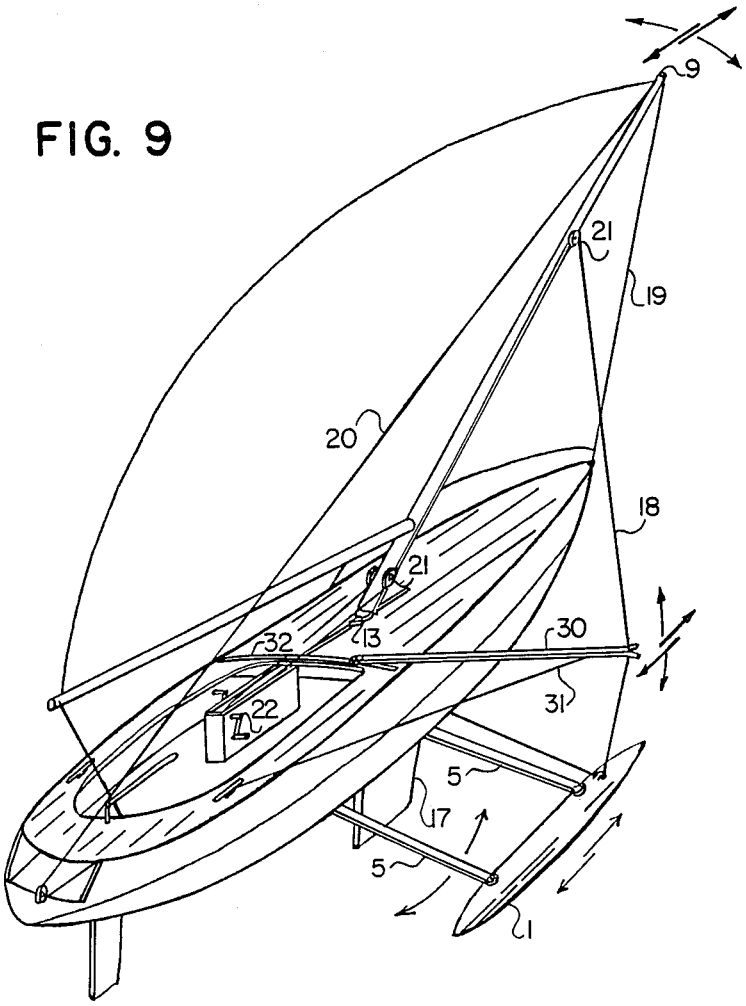

FIG. 9 shows a sailboat with the dolphin suspended on two bars in such a way that it can be swung both laterally and fore and aft. The bars are fastened to universal joints on the bottom of the hull, one in front and the other aft of the keel. The dolphin is hoisted by ropes passed through pulleys fastened to the mast. The dolphin is shifted fore and aft by means of an outrigger spar that can be swung both up and down and fore and aft. The foot of the mast is supported in a ball-and-socket joint or universal joint that can be shifted fore and aft on a rail and arrested. The mast is inclined toward the bow or stern by taking up or letting out on the headstay or backstay.

FIG. 10 shows a sailboat with the dolphin fastened by means of two rotating bars to the bottom of the keel. Each bar is fastened to the keel with a universal joint and to the dolphin with a hinge joint. As a result, the dolphin can be swung out to the side and shifted fore and aft. The dolphin is hoisted on the port or starboard sides by means of ropes passed through pulleys on the mast. The dolphin can also be hoisted in the fore or aft direction when it is located in its neutral position vertically below the keel in order to allow the boat to sail in shallow water.

FIG. 11 shows a cross-section through the hull of a configuration according to FIG. 10. In this configuration, the three centres of rotation—mast pivot point (B), hull's centre of roll (J) and centre of rotation (H) of the dolphin's suspension—are set at different levels. This means, however, that torques are transmitted to the hull, a fact that has to be taken into consideration in the boat's design.

Figure 8:
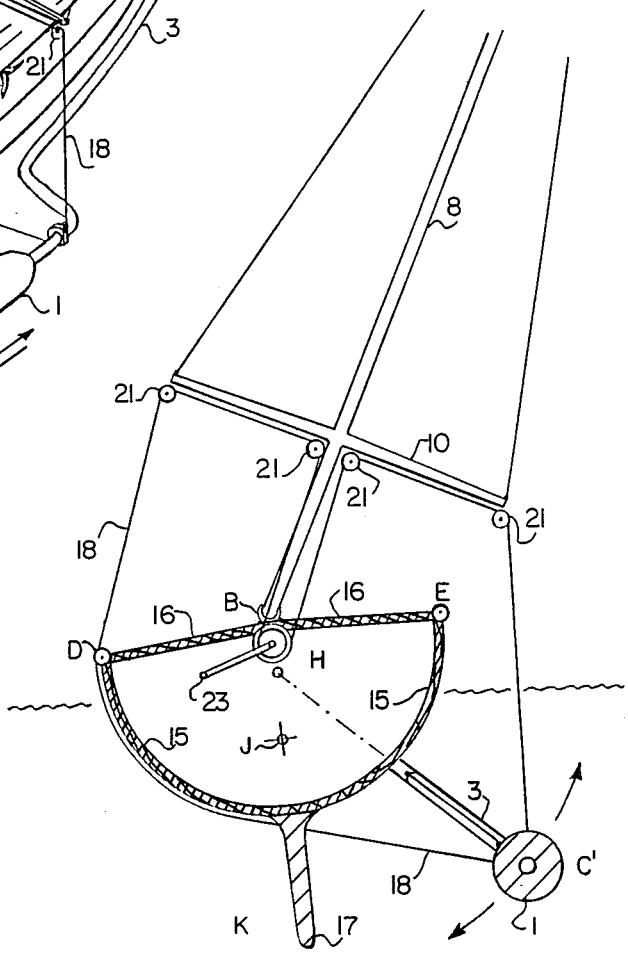

In order to eliminate torques acting on the hull around the fore-and-aft axis and heeling of the hull as far as possible, it is advantageous if the pivot point of the mast (B) and the centre of rotation of the dolphin (H) coincide with the hull's centre of roll (J) (FIG. 8 and FIG. 11). However, the torques acting on the hull include not only those produced by the distance between points B and H and point J, but also the torque caused by the force acting on the keel (or centreboard), the drift resistance, and finally also the torque caused by asymmetrical loading of the boat.

FIG. 12 shows a sailboat in which the pivot point of the mast and the centre of rotation of the dolphin lie in a common axis. This axis can coincide with the hull's centre of roll. But it can also be set somewhat higher in order to counteract the torque produced by the drift resistance on the keel.

The mast is free to rotate laterally until it contacts the top deck. A mast foot joint (N) fastened to the mast's rotation wheel allows the mast to be inclined fore and aft as well by taking up or letting out on the headstay and backstay.

The dolphin is suspended from the rotation axis by means of an L-shaped bar. The dolphin can be shifted fore and aft on this bar, e.g. by means of tackle installed inside the bar (which in this case is a tube). The tackle for shifting the dolphin fore and aft can be connected with the lines of the headstay and backstay in such a way that if the dolphin is moved toward the stern the mast is inclined accordingly toward the stern. The dolphin can be swung upward to the side as far as the cutout in the boat's hull permits.

FIG. 13 shows a cross-section through the hull of a sailboat according to FIG. 12. The hull is practically cut in two parts, which are sealed watertight at the cutout. These two hull parts are joined rigidly together by two continuous, load-bearing box sections (M), one on the port side and the other on the starboard side. In the resulting cutout in the bottom of the hull, the arm of the L-shaped dolphin suspension is free to rotate to the side until it strikes the edge of the box section (M).

The pivot point of the mast (B) and the centre of rotation of the dolphin suspension (H) coincide and are located in a gearbox joined rigidly to the hull. By means of a gearing system, which can exist, for example, as indicated in FIG. 13, of an outer wheel bearing the mast and an inner wheel bearing the dolphin suspension, the angle between mast and dolphin is adjustable and fixable. Mast and dolphin make up a unit that is supported to rotate freely in the gearbox without transmitting a torque to the hull.

Figure 14:
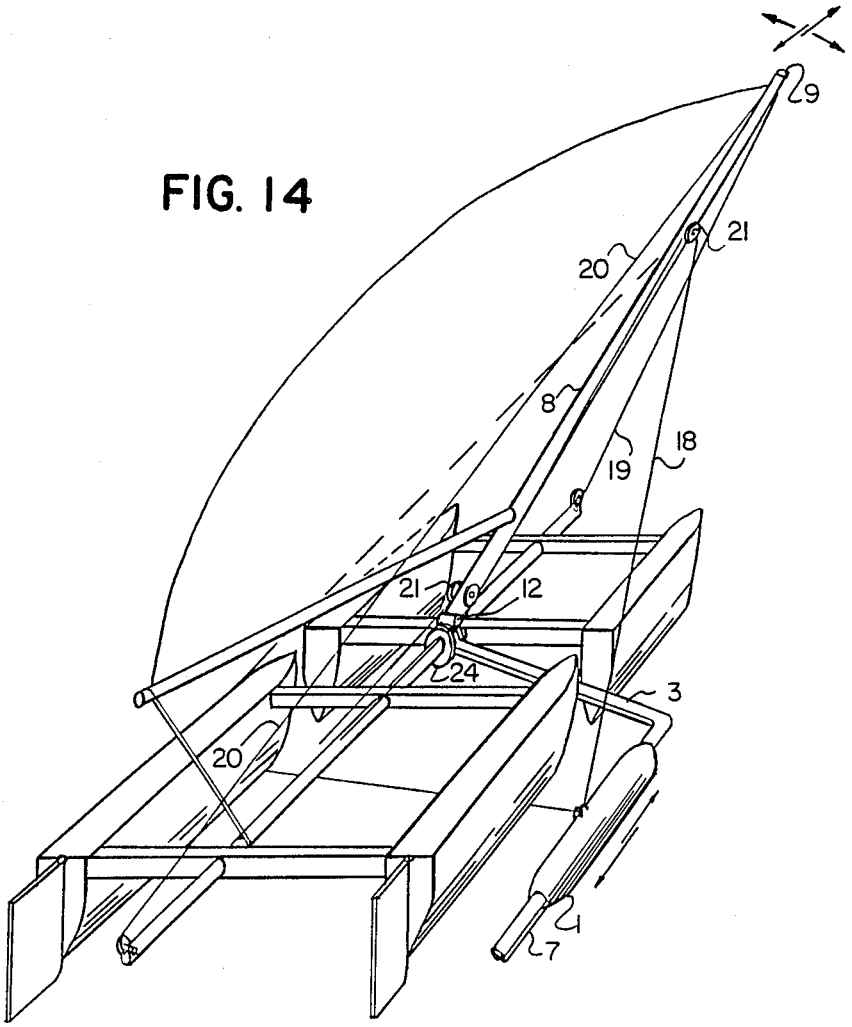

FIG. 14 shows a catamaran. According to FIG. 12 and FIG. 13, the mast rotation point and dolphin rotation point are combined in a common hub. The "two" hulls are completely severed to form four watertight pontoons. The dolphin arm is free to swing out even above the surface of the water. The dolphin can be shifted fore and aft on the L-shaped suspension arm. A second mast foot joint permits adjustable inclination of the mast fore and aft by means of the headstay and backstay.

FIG. 15 shows a sailboat in which the rotation wheel bearing the mast and the rotation wheel bearing the dolphin both have the same diameter as the hull and are integrated into the wall of the hull. The ring shape of these wheels provides free passage. In the case of larger yachts with a cabin, these rotation rings can be integrated into the curved cabin roof at the top. One rotation ring or a double ring carries a yoke (P), to the ends of which the shrouds (W) are fastened (FIG. 16). The suspension arm of the dolphin is fastened to another rotation ring. The rings run on external rollers and are supported to rotate freely independently of the hull.

FIG. 16 shows a cross-section through the type of configuration shown in FIG. 15. Mast rotation ring and dolphin rotation ring are mutually adjustable and fixable by means of gearing. The angle between the mast and the dolphin arm can be freely selected and arrested to suit the wind conditions. As in the case of the configuration according to FIG. 12 and FIG. 13, the hull is severed on the outside. In this case, however, the cutout is made all the way round, and both the dolphin arm and the mast can be rotated toward each other until they come into contact with each other. The tunnel-shaped structural section (0) serves as load-bearing connection between the fore and aft parts of the hull. The cutout in the exterior surface of the hull can be closed with movable jalousie slats (L), making the hull surface relatively smooth.

Figure 17:
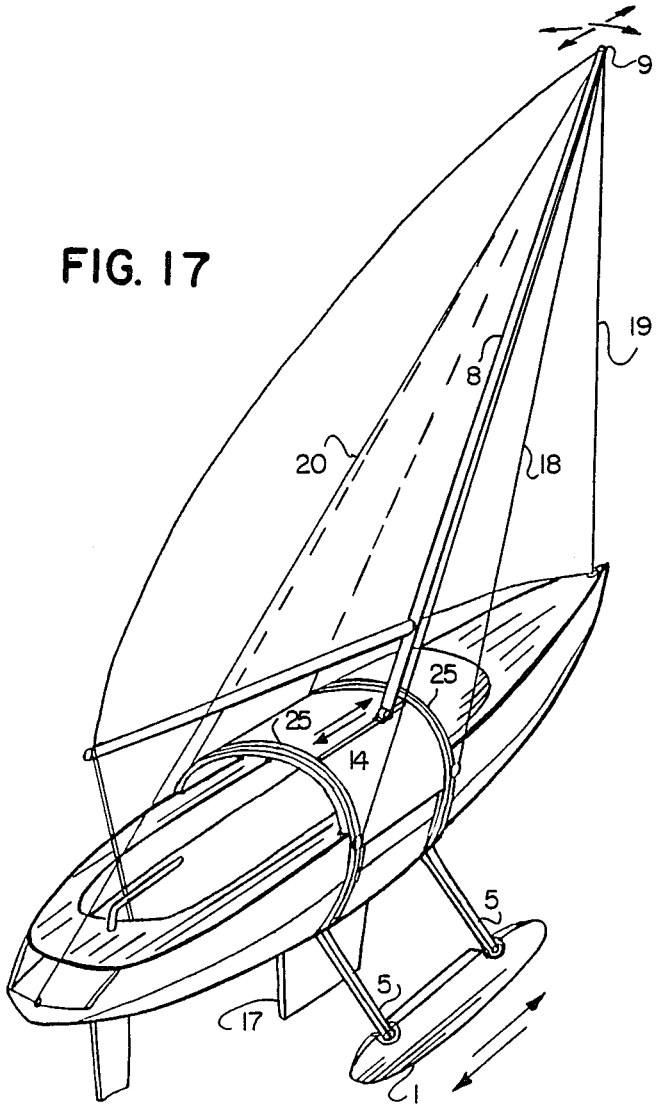

FIG. 17 shows a sailboat with two ring systems encircling the hull. The cylindrical centre section between the two ring systems bears the mast and is supported in such a way that it can rotate freely around the hull. The dolphin is suspended on two arms. Each of these two dolphin arms is fastened to one ring of the ring systems similarly to FIG. 15, which are also supported to allow free rotation and are adjustable and arrestable in relation to the cylindrical centre section. Hence the dolphin can be rotated freely in relation to the mast around the boat's fore-aft axis and fixed at any desired angle. Mast and dolphin can be swung fore and aft on joints at the foot of the mast and at the dolphin arms, respectively. In addition, the mast can be shifted fore and aft on a rail on the cylindrical section and arrested at an appropriate point.

The designs according to FIG. 15 and FIG. 17 are also suitable for boats carrying more than one mast. As many ring systems can be employed as required for the number of masts.

SPECIFIC DESCRIPTION OF THE INVENTION

As illustrated diagramatically in FIGS. 1 to 4, the present invention constitutes a structural system that enables the mast of a sailboat to be inclined to luff and astern when the boat is sailed close to the wind. Positioning the mast in this manner makes it possible to sail a sailboat using the technique of a windsurfing sailboard. The advantages of sailing a sailboat like a sailboard are: (a) Improved sail positioning, and therefore better utilization of the wind force. This increases the boat's speed. (b) When the boat is sailed close to the wind, the resultant force acting on the sail is directed "leeward-forward-upward". In addition to its original function as a means of propulsion, therefore, the sail also acts like a lifting wing. Consequently, the boat is lifted and the hull's draft, and therefore its displacement, is reduced. (c) The hull does not heel over, which means that the optimal, most streamlined position of the hull can be retained. This increases the boat's speed and enhances the passenger's comfort.

FIGS. 5 to 17 show some examples of ways in which the structural system can be designed in order to implement the basic elements and characteristic features of the invention and fulfill the principle functions. The examples shown in the illustrations are deliberately simplified in order to make the essential characteristics of the invention as comprehensible as possible. The designs can also be more complex, however; in particular, the elements shown in the various examples and their arrangement can be interchanged or employed in combination.

This underscores the fact that the present invention relates not to any specific design detail, but to a structural system.

1. Specifications for the dolphin:

The dolphin (1) is a streamlined pendulum weight made of a material with high specific gravity, e.g. steel. The weight of the dolphin is selected in relation to the size of the sail.

2. Specifications for the inclinable mast:

The mast (8) stands with its bottom end in a mast foot (11), which is constructed in the form of a mast foot joint (12). The mast foot joint (12), which is constructed as universal joint or ball-and-socket joint, enables the mast (8) to be inclined in any direction. The mast foot joint (12) is joined to the hull (15) either at the deck (16) or at a lower level, e.g. at the boat's center of rotation. The mast foot joint (12) can be mounted on a small carriage (13) that can be shifted on rails (14) both fore and aft and also sideways and can be fixed in any desired position. In certain versions, the mast (8) carries a number of pulleys (21) on the mast tip (9) and at the ends of the spreader (10) and along the mast, over which the ropes (18) of the dolphin's suspension system run. In certain versions (FIGS. 12,13), the mast foot (11) is joined to the dolphin suspension arm (3) by means of a gear unit (24). In the other versions (FIGS. 15, 16), the mast foot (11) is joined to the dolphin suspension arm (4) by means of a ring system (25). This gear unit (24) or ring system (25) is the means of changing and fixing the angle between the mast (8) and the dolphin suspension arm (3) and (4) respectively. The fixed unit, consisting of the mast (8) with the dolphin suspension arm (3) or (4) and dolphin (1), is free to rotate around the center of the gear unit (24) or ring system (25).

3. Specifications for the suspension system:

The suspension system, which allows a freely selectable and fixable connection between the mast (8) and the dolphin (1), consists of ropes (18) for positioning the mast (8) instead of shrouds and forestay (19) and backstay (20). Shortening or lengthening these ropes decreases or increases the angle between the mast tip (9), the mast foot (11), and the center of gravity of the dolphin (1). The ropes of this suspension system run over pulleys (21) on the mast (8) and on the hull (15). The shortening and lengthening of the ropes (shrouds (18), forestay (19), and backstay (20)) is accomplished with winches (22) powered either by manual crank (23) or motors. The winches that shorten or lengthen the shrouds (18) run in coordinated fashion. Similarly, the winches that shorten or lengthen the forestay (19) and the backstay (20) also run in coordinated fashion. Similarly, the winches that shorten or lengthen the forestay (19) and the backstay (20) also run in coordinated fashion. In other words, the amount of rope length which is shortened on one side (e.g. port), has to be lengthened on the other side (starboard) by the same amount.

Figure 5:
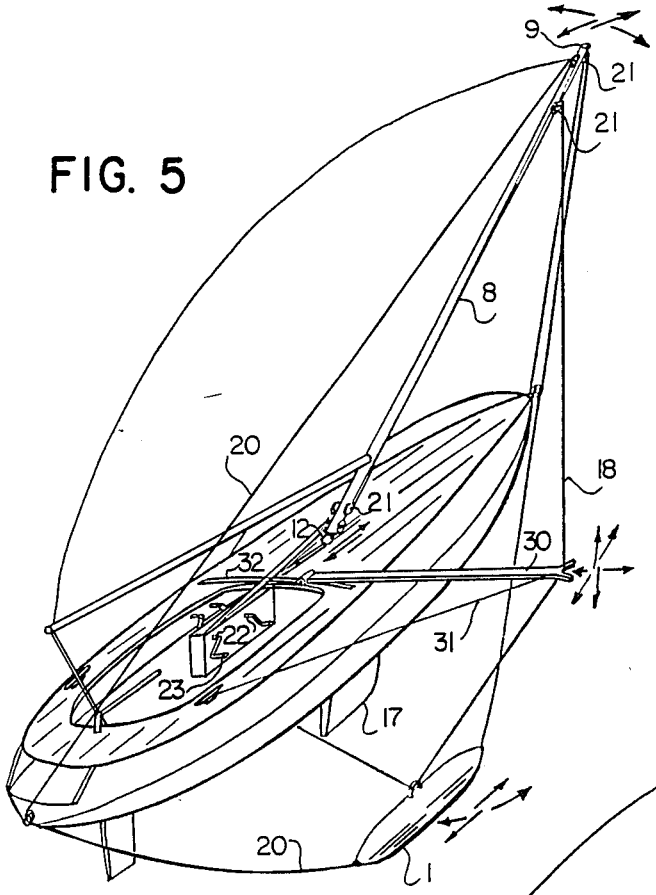
Figure 6:
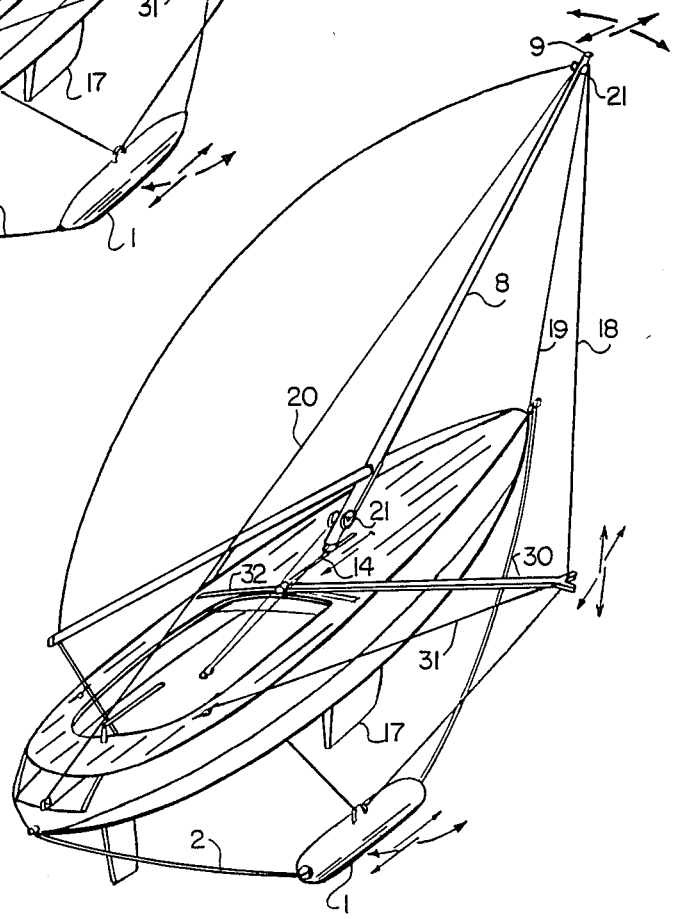
Figure 7:
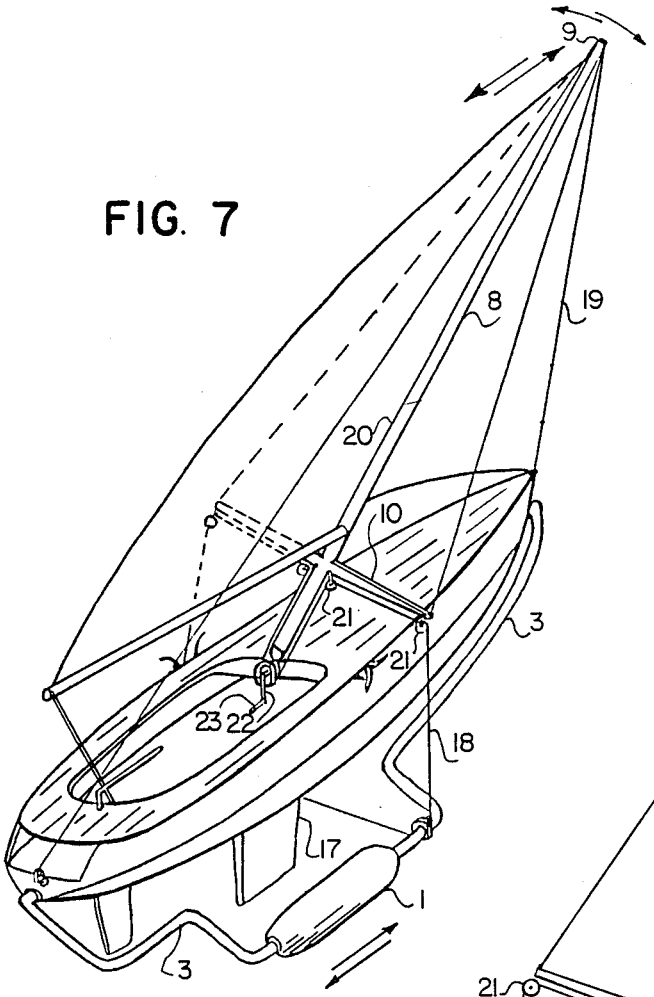

4. Specifications for the pendulum arm system:

The pendulum arm system, which establishes the oscillation path of the dolphin (1), consists of one pendulum arm (4) or two pendulum arms (5). At one end the pendulum arms are joined to hull (15) by joints (6), at the other they are joined to the dolphin (1). In some versions (FIGS. 7,8,12,13, 14), the pendulum arm system consists of a stirrup (3) that swings to both sides of the boat or, as shown in FIG. 6, of a heavy rope (2). At the outer end of the pendulum arm, i.e. the stirrup (3), the dolphin (1) can be shifted fore and aft by control lines (7). In other versions (FIGS. 9,10, 11,17), the pendulum arm system consists of two pendulum arms (5) that carry and control the dolphin (1). These pendulum arms are attached to the hull with universal joints (6), enabling them not only to swing out to the side but also to be inclined abaft in trapezoidal fashion. In this version, the trapezoid angle can be adjusted and fixed at will. The pendulum arms (4) and (5) or the stirrup (3) are attached to the bottom of the hull (15) or, as shown in FIGS. 10 and 11, are fastened to the bottom of the keel (17) with joints (6). In other versions (FIGS. 15,16,17), the dolphin suspension arms are fastened to a ring system running around the hull's periphery (15) or to a carriage traveling on rails around the hull's periphery. In some versions (FIGS. 5,6,9), the dolphin is positioned with an outrigger spar (30) instead of pendulum arms or in conjunction with pendulum arms. This positioning spar (30) may be either a straight, rigid spar or one capable of being extended in telescope fashion. It is fastened to the boat deck (16) at one end and engages the ropes (18) of the suspension system at the other. The spar can be swung and extended to port or starboard, or it can be shifted to port or starboard on a rail (32) attached to the deck. The positioning spar (30) can also be swung fore and aft (e.g. with a rope (31) or a rod) and fixed in any position, thus making it possible to position the dolphin (1) in the fore-and-aft axis.

5. Gearing systems:

The suspension system and the pendulum arm system complement each other. Versions are also described here in which the function of the suspension system, i.e. mast positioning, and the function of the dolphin support system, i.e. establishment of the dolphin's oscillation path, are combined in a single structural unit. FIGS. 12 and 13 show a joint situated at the boat's center of rotation that serves both as joint for the mast foot (11) and joint for the pendulum arm (3) of the dolphin. The two joints are connected by a gear unit (24) in such a way that the angle between the mast tip (9), the mast foot (11), and the center of gravity of the dolphin (1) can be adjusted and fixed in the desired position. The unit fixed in this way, consisting of the mast (8) and the pendulum arm (3), is free to swing in relation to the hull (15). This version can be designed so that the hub of gear unit (24) is oriented longitudinally in relation to the hull and is joined rigidly to it (15). With this type of design, the dolphin (1) and the mast tip (9) can oscillate only in planes that lie perpendicular to the boat's fore-and-aft axis. In another version, the hub of gear unit (24) is attached to a swiveling bogie; rather than merely being oriented fore-and-aft, it can be directed at will and fixed simply by turning the bogie. As a result, the oscillating planes of the dolphin (1) and the mast tip (9) can be selected and fixed at will in relation to the boat's fore-and-aft axis.

Instead of a compact gear unit located centrally in the hull, it is possible to use a large gear in the form of two concentric rings (25), which surround the hull (15) and are integrated into the hull wall. This design (FIGS. 15,16) eliminates the hub in the ring's center of rotation. One of the rings, mast ring (26), is joined to the mast (8), the other, the dolphin ring (27), is joined to the dolphin arm (4). The two rings can be counter-rotated concentrically by gears (28) and fixed in position. Both rings are free to rotate in relation to the hull (15). The mast foot (11) and the pendulum arm (4) of the dolphin are joined to their respective rings with ordinary joints in such a way that they can be inclined fore and aft. In the design shown in FIGS. 15 and 16, the mast ring (26) carries a yoke (29) to the ends of which the shrouds are attached.

6. Motor power and hydraulic systems:

The relative position of mast and dolphin is changed and fixed with the aid of winches or gear units. These winches or gear units are powered either manually by means of cranks or by motors. It is also possible to adjust and fix the relative positions of the mast (8) and the dolphin pendulum arm (4) by means of hydraulic systems rather than winches or gear units.

7. Monitoring systems and control systems:

The force of the wind acting on the sail and the mast changes as a function of sail size, wind velocity, and course. The optimal mast position is determined either on the basis of the skipper's experience and judgement, or on the basis of anemometers and dynamometers that establish mast direction and inclination. The information yielded by the anemometers and dynamometers is used by microprocessors for the programmed, automatic control of the motors and hydraulic systems with which the relative position of the mast (8) and the dolphin (1) is changed and fixed.

8. Other sailing equipment:

It is pointed out herewith that the described structural systems, such as illustrated in FIG. 14, are also applicable to sailboats with more than one hull (i.e. catamarans, trimarans). The described structural systems are also applicable to sail-powered vehicles running on a solid substrate on wheels or runners.

I claim:

1. A sailboat comprising:

a hull, a mast upstanding from said hull, the bottom end of which, a mast foot, is connected to said hull by an articulated joint that allows the mast to be inclined in any direction, a keel that is connected rigidly to said hull and stabilizes the hull against heeling with its weight and also helps to keep the sailboat from drifting off course, a "dolphin", a streamlined underwater pendulum weight, which can be moved under said hull both to port and starboard and fore and aft, and which can be lifted sideways in relation to the hull even above the water level, a suspension system connecting said dolphin with said mast, with which the inclination of said mast can be changed and set both sideways and fore and aft, in order that:

the wind force acting on said mast will be transmitted to said hull with little or no effective torque, said mast can be drawn by the weight of said dolphin past the vertical to windward (luff) and can also be inclined aft, and the sailboat can be sailed according to the principle of a windsurfing sailboard by positioning the dolphin accordingly.

2. A sailboat according to claim 1, wherein the position of said mast in relation to the position of said dolphin is set suitably by varying the angle formed by the mast tip, the mast foot, and the dolphin's center of gravity.

3. A sailboat according to claim 2, wherein the torque applied by said dolphin to said mast is established not only by altering the angle, but also by altering and appropriately setting the distance between the dolphin's center of gravity and said mast foot.

4. A sailboat according to claim 3 wherein the suspension system for said dolphin consists of a plurality of stays passing over pulleys, said stays being shortened by being taken in or lengthened by being payed out in order to vary said angle, whereby those stays controlling the movement of said dolphin and said mast port and starboard, i.e. the lateral stays, are taken in and paid out in coordinated fashion, and those stays controlling the movement of said dolphin and said mast toward the bow and stern, i.e. the fore and aft stays, are likewise taken in and payed out in coordinated fashion.

5. A sailboat according to claim 4, wherein the oscillation path of said dolphin is influenced by a positioning spar that serves simultaneously for transmitting forces acting on said suspension system and said dolphin to said mast foot or said hull.

6. A sailboat according to claim 4, wherein the oscillation path of said dolphin is controlled by one pendulum arm or two pendulum arms that are attached at the shoulder end to said hull or said keel with joints or to said mast foot with a gear unit, and that carry and guide said dolphin at the other end.

7. A sail-powered vehicle, i.e. a sailboat or a catamaran or a vehicle equipped with wheels or runners with a sail arrangement according to claim 3, wherein said dolphin is attached to a pendulum arm of variable length, said pendulum arm being joined to said mast by a universal joint or a gear unit in such a way that the inclination of the mast is possible in any direction and is controlled by the position of the dolphin.

8. A sailboat according to claim 3, wherein said dolphin is fastened to a pendulum arm that is joined to a ring system integrated into the wall of said hull, whereby said ring system serves for fixing said mast in the desired position in relation to said dolphin and allows the fixed unit, comprising mast, pendulum arm, and dolphin, to rotate freely in relation to said hull.

9. A sailboat according to claim 3, wherein said angle between mast tip, mast foot, and center of gravity of the dolphin on the one hand, and said distance between the mast foot and the dolphin's center of gravity on the other, are controlled by anemometers and force sensing devices that control the motorized hydraulic systems with which said angle and said distance are altered.

10. A sailboat according to claim 3, wherein more than one mast are positioned and controlled by one or more dolphins.

* * * * *